United States Patent [19]

DeFilippis et al.

[11] Patent Number: 4,605,277

[45] Date of Patent: Aug. 12, 1986

[54] CONNECTOR AND METHOD OF MAKING

[75] Inventors: Pietro DeFilippis, Aversa; Amedeo Salvatore; Mario Biscione, both of Naples, all of Italy

[73] Assignee: Texas Instruments Incorporated, Dallas, Tex.

[21] Appl. No.: 710,347

[22] Filed: Mar. 11, 1985

[30] Foreign Application Priority Data

Jun. 13, 1984 [IT] Italy ..... 48391 A/84

[51] Int. Cl.[4] ..... H01R 11/22

[52] U.S. Cl. ..... 339/262 R

[58] Field of Search ..... 339/259 R, 259 F, 262 R, 339/262 RR, DIG. 1

[56] References Cited

U.S. PATENT DOCUMENTS

| | | | |
|---|---|---|---|
| 3,605,078 | 9/1971 | Paullus | 339/259 R |
| 4,487,465 | 12/1984 | Cherian | 339/262 R |
| 4,534,603 | 8/1985 | Brown et al. | 339/262 R |

FOREIGN PATENT DOCUMENTS

| | | | |
|---|---|---|---|
| 931633 | 11/1947 | France | 339/262 R |
| 860331 | 2/1961 | United Kingdom | 339/259 F |

*Primary Examiner*—Gil Weidenfeld
*Assistant Examiner*—Gary F. Paumen
*Attorney, Agent, or Firm*—James P. McAndrews; John A. Haug; Melvin Sharp

[57] ABSTRACT

A high reliability low cost connector has flat retainers blanked from an electrically conductive sheet metal and inserted into opening in an electrically insulating body. Each retainer has a post at one end extending from an opening at one side of the body and has a pair of integral wings spaced from each other in a plane at its opposite end disposed in the opening at the opposite side of the body. Spring clips are blanked and formed from an electrically conductive sheet metal spring material and are inserted into the body openings so loop portions of the clips fit between the pairs of retainer wings in each opening and are biased into resilient electrical engagement with the retainer wings. Each clip preferably has two pairs of juxtaposed spring leaves integral with the loop spaced at 90° relative to each other around a common axis to grip a terminal inserted between the spring leaves. The loops are also formed with interruptions in each loop in a common location between two adjacent spring leads. The sheet metal retainers and clips are inserted into the body openings while suspended from support strips left during the blanking steps and are then separated from the support strips. In that way the retainers and clips have predetermined uniform orientations in the openings.

9 Claims, 9 Drawing Figures

CONNECTOR AND METHOD OF MAKING

BACKGROUND OF THE INVENTION

The field of this invention is that of connectors used in mounting multi-terminal integrated circuit units on printed circuit boards and the invention relates more particularly to a low cost connector adapted for applications requiring high reliability.

Connectors for mounting multi-terminal integrated circuit units on printed circuit boards conventionally have contact members mounted in openings in a molded electrically insulating body. The contact members have a post extending from one side of the body to be connected in an electrical circuit and has spring means on the opposite end of each contact member to resiliently grip integrated circuit terminals inserted into the body openings. When such connectors are intended for military applications and the like requiring particularly high performance reliability, the contact members are typically formed in two parts. One part comprises a post formed by screw machine from a brass rod or the like and has an axial bore in one end of the post. A spring clip formed of conductive spring material is then pressed into the bore and is adapted to resiliently engage an i.c. terminal inserted into the bore. Two part contact members of this type are mounted in individual body openings and provide high performance but the contact members are relatively expensive to manufacture and are particularly expensive to assemble with the connector bodies. Further, the spring clips inserted into the contact members typically comprise a ring of spring material having pairs of springs leaves depending from the rings to make resilient engagement with i.c. terminals inserted into the rings. Such rings usually have an interruption in the ring and that interruption as well as the spring leaves usually have random locations in the post bores so the connectors are frequently limited to use with round i.c. terminals or the like. It would be desirable if such high performance connectors could be manufactured and assembled at lower cost and could be adapted for use with strip type i.c. terminals for providing a high reliability performance in many other potential applications.

SUMMARY OF THE INVENTION

It is an object of this invention to provide a novel and improved high reliability low cost connector; to provide such a connector having a structure which is characterized by high performance; to provide such a connector which is adapted for use with round or strip type terminals; to provide such a connector having a structure which is characterized by ease of manufacture; and to provide novel and improved methods for manufacturing such connectors.

Briefly described, the novel and improved connector of this invention is made by blanking a plurality of retainers from a strip of electrically conductive sheet metal material such as steel, brass, copper or the like. Each retainer is blanked so surface portions of the retainer are juxtaposed in spaced facing relation to each other. Preferably the retainers are blanked so they initially remain connected to and supported by portions of the strip material which are left during the blanking step. Preferably the retainers are blanked flat and each comprises a pair of wings which are disposed in spaced, side-by-side relation to each other in a plane at one end of the retainer. In that way, respective edge surfaces of the wings are juxtaposed in spaced facing relation to each other. Preferably the retainers are also provided with a flat post which extends from a pair of wings in the same plane. If desired, detents are raised on the spaced facing edge surfaces of the wings adjacent the distal ends of the wings.

A plurality of spring clips are also blanked and formed into selected configuration from a strip of electrically conductive sheet metal spring material such as beryllium copper, stainless steel, phosphor bronze or the like. Each clip is blanked and formed to have a loop portion and to have a plurality of integral spring leaves extending from the loop in juxtaposed relation to each other. Preferably the clips are blanked from the strip materials so they initially remain connected to and supported by portions of the strip which are left during the blanking step. Preferably each clipped loop has two pairs of juxtaposed spring leaves arranged 90° apart around a common axis and the clip loops have interruptions at common locations on the loops between two adjacent spring leaves.

An electrically insulating body is also provided with an opening for receiving a retainer and a spring loop. Preferably for example the body is molded of glass-filled nylon or other suitably rigid electrical insulating material or the like so that a plurality of openings are provided in the body spaced in two rows along the length of the body so the openings extend between opposite sides of the body.

In assembling the connectors, a group of the retainers is positioned over the body and the retainers are inserted into the respective body opening so that the retainer posts preferably extend from an opening at one side of the body and so that pairs of retainer wings are disposed in the respective opening at the opposite sides of the body. Preferably the body openings are provided with pairs of notches, the notches being disposed at opposite sides of the opening and being oriented in the openings so that the notches in each row of openings are disposed in a common plane extending along the length of the connector body. The retainers are then inserted into the body openings while still attached to the support means provided in the blank strip metal so the outer edges of the retainer wings are received within the notches for positioning the retainers with selected orientations in the body openings. The support strip means are then separated from the retainers by breaking or another conventional manner. The spring clip means are then inserted into the body opening so that the looped portions of the clips are received between the pairs of wings on the retainers in the respective openings to be held between the wings biased into resilient electrical engagement with the retainers. Preferably the clips are inserted into the body openings while still attached to the support means provided during the blanking step and are pressed between the retainer wings to be held between them by the detents provided on the wings so that the clips are positioned in the body openings with a common and precisely precisely predetermined orientation in the openings. The support strip means are then removed from the spring clips by breaking or another conventional manner. In that way the spring leaves provided on the clips and the interruption in the spring clip loops are oriented in the connector body so the connector is adapted to receive strip-shaped i.c. terminals and to make selected face and edge engagement with such terminals.

DESCRIPTION OF THE DRAWINGS

Other objects advantages and details of the novel and improved connector and method of manufacture provided by this invention appear in the following detail description of the preferred embodiments of the invention, the detailed description referring to the drawings in which.

DESCRIPTION OF THE PREFERRED EMBODIMENTS

Figure 1:
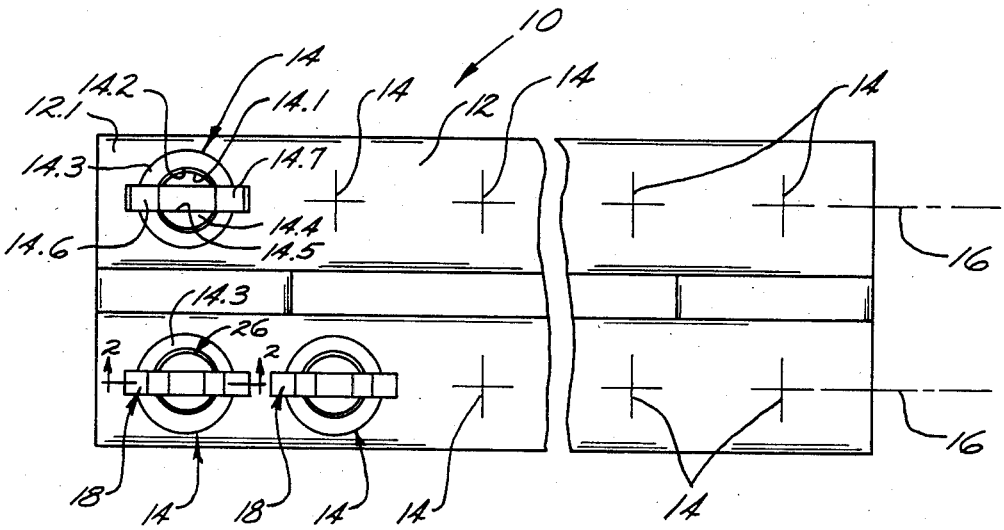
FIG. 1 is a plan view of the connector of this invention.
Figure 2:
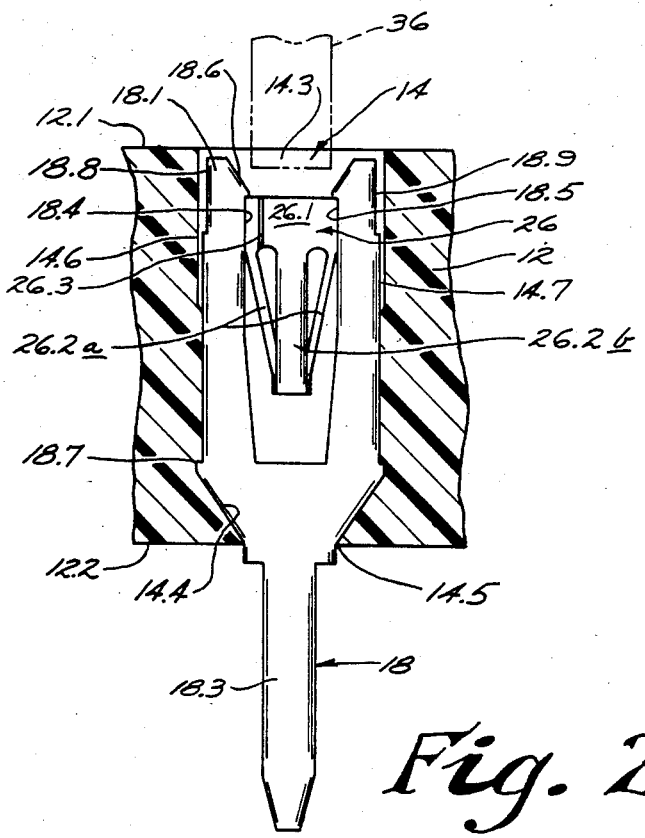
FIG. 2 is a section view to enlarged scale along line 2—2 of FIG. 1.

In FIGS. 1-2, 10 indicates the connector of this invention having an electrically insulating body 12 molded or the like of a rigid electrically insulating material such as glass-filled nylon or the like. A plurality of openings 14 are spaced along the body length in a pair of grooves to extend through the body from the top side 12.1 to the bottom side 12.2. Preferably each opening has a central bore part 14.1 of selected diameter, an upper portion 14.2 of a slightly larger bore diameter, an upper tapered portion 14.3 opening at the top side 12.1, and a lower tapered portion 14.4 opening at the bottom 12.2 in a rectilinear opening 14.5. There are preferably notches 14.6, 14.7 at opposite sides of each opening at the top of the body oriented so the notches in each row are disposed in a common plane 16 along the length of the body.

A plurality of retainers 18 of an electrically conductive sheet metal such as steel, brass, or copper or the like are inserted into the respective body openings 14, one retainer being omitted from an opening shown in Fig.1 for clarity of illustration. Preferably stiff low cost strip materials are used in the retainers. Each retainer has surfaces which are disposed in juxtaposed, spaced, facing relation to each other. Preferably the retainers are flat, have a pair of wings 18.1, 18.2 disposed in a plane in spaced side-by-side relation at one end of the retainer and have a post 18.3 extending in that plane away from the wings. Edges surfaces 18.4, 18.5 of the respective wings are juxtaposed in spaced facing relation to each other and detents such as bumps 18.6 are preferably provided on those surfaces near the distal ends of the wings. Barbs 18.7 are also preferably provided on the outer edges of the retainers for securing the retainers in body openings 14.

Figure 3:
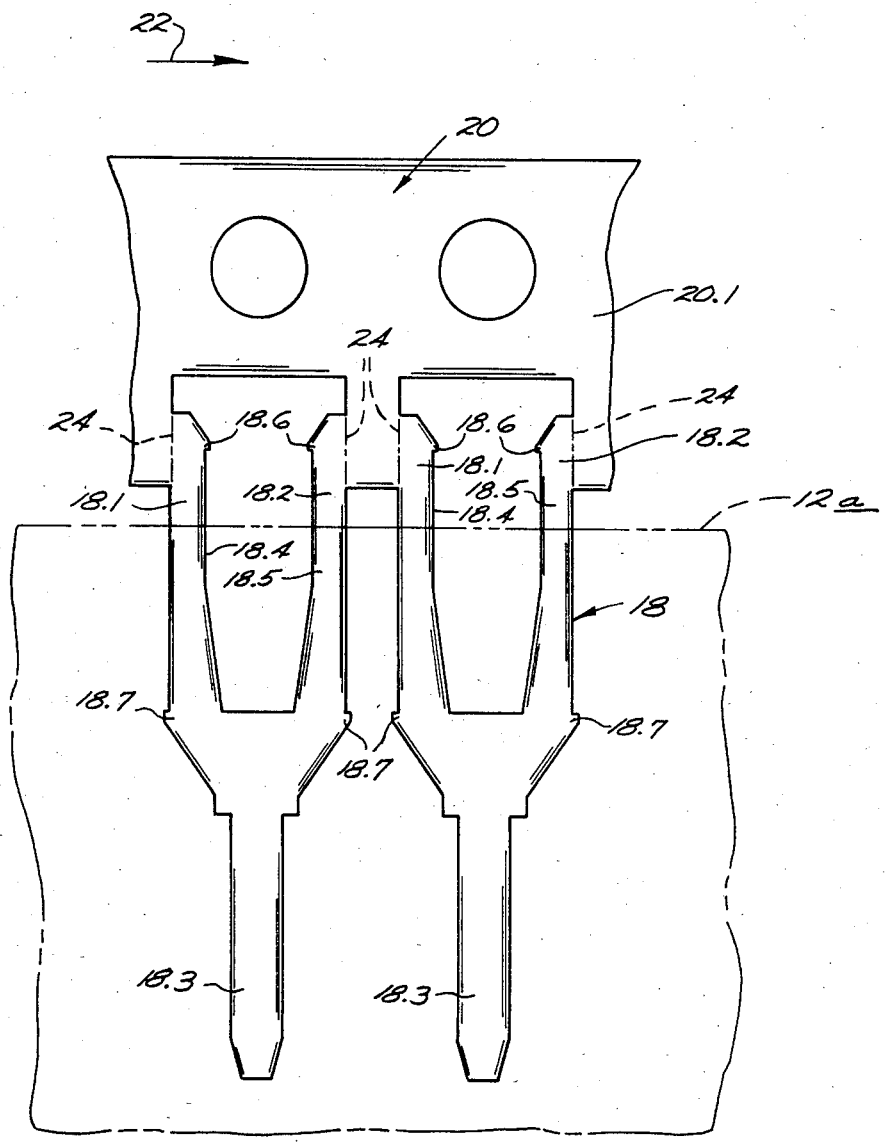
FIG. 3 is a side elevation view to enlarged scale illustrating formation and assembly of retainers used in in the connector of FIG. 1.

The retainers 18 are preferably stamped or blanked in continuous sequence from a continuous strip 20 of the electrically conductive sheet metal as the strip material is advanced from a supply as diagramatically illustrated by the arrow 22 in FIG. 3. The retainers are blanked so they initially remain connected to support portions 20.1 of the strip left during the blanking. The retainers are then positioned over the connector body (as indicated in broken lines 12 a in FIG. 3) and are inserted into the body openings 14 with outer edges 18.8, 18.9 of the retainer wings received in the respective notches 14.6, 14.7. The retainers are then cut from the support strips 20.1 in any conventional manner as is diagrammatically indicated by the broken lines 24 in FIG. 3 so the retainers are separated from each other and are further inserted into the opening to the position shown in FIG. 2. In that arrangement, the group of retainers fitted into the openings in the body 12 have the same orientation in the openings, the retainer posts extend from the openings at the bottom side of the connector body to be electrically connected to an electrical circuit on a printed circuit board as to be understood, and the pairs 18.1, 18.2 of the retainer wings are disposed in the openings 14 adjacent the opposite or top side 12.1 of the body. The barbs 18.7 are seated in the body material and the retainer wings have some play in the openings 14.

Figure 4:
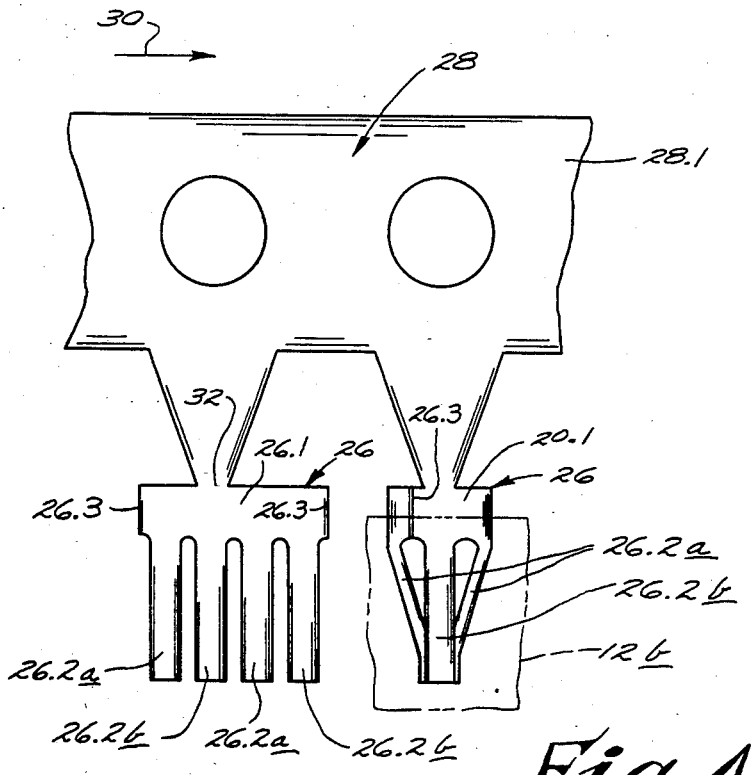
FIG. 4 is a side elevation view to enlarged scale illustrating formation and assembly of spring clips used in the connector of FIG. 1.

A plurality of spring clips 26 of an electrically conductive sheet metal spring material such as stainless steel, beryllium copper or phosphorus bronze or the like are also inserted into the respective body openings. Each clip has a loop portion 26.1 received between the pair of retainer wings 18.1, 18.2 in the opening and the loop configuration is selected so the loop is biased into resilient electrical engagement with the retainer wings. A plurality of integral spring leaves 26.2 extend from the loop in juxtaposed relation to each other. Preferably the spring clips 26 are stamped or blanked in continuous sequence from a continuous strip 28 of the sheet metal spring material as the strip is advanced from a supply as diagrammatically illustrated by the arrow 30 in FIG. 4. The clips are blanked and are then formed to provide the desired loop configuration 26.1 and to provide any desired prestress in the spring leaves 26.2 as is diagrammatically illustrated at 26.2*a* and 26.2*b* in FIG. 4. In that forming, an interruption 26.3 is left in the loop portion of each clip at a common location between two adjacent spring leaves 26.2 as shown in FIGS. 2 and 4. The clips are blanked so they initially remain connected to support portions 28.1 of the strip left during the blanking step. They are then positioned over the connector body (as indicated in broken lines 12*b* in FIG. 4) and are inserted into the body openings 14.. They are then cut or broken away from the support strip 28.1 in any conventional way as is diagrammatically illustrated by the broken lines 32 in FIG. 4 and are further inserted into the opening between the retainer wings 18.1, 18.2 under the detents 18.6 to the position shown in FIG. 2. In that arrangement, the clips 26 are inserted into the body openings 14 with the same orientation in the openings. They are firmly positioned in the openings by their engagement with the wings 18.1, 18.2 and with the walls of the inner bore section 14.2. If desired, the inner surfaces 18.4, 18.5 are the retainer wings taper in toward the post 18.3 for limiting the insertion of the clip 26 between the wings. Preferably each clip is provided with two pairs 26.2*a*, 26.2*b* of the integral spring leaves which are spaced at 90° from each other around a common axis indicated at 34 in FIG. 4. They are also inserted into the body openings 14 so the juxtaposed pairs of spring leaves 26.2*a*, 26.2*b* in each row of openings are disposed so that the broad faces of the pairs of leaves are respectively perpendicular and parallel to the planes 16 extending along the length of the connector body. The interruption 26.3 on the clip loop also has an oblique orientation relative to the plane 16. In that way, the spring leaves 26.2 are positioned so terminals of an integrated circuit unit are inserted into the body opening as indicated by broken lines 36 in FIG. 2 are adapted to be detachably and resiliently engaged by the pairs of spring leaves on each clip for electrically connecting the terminals to the noted printed circuit board circuit as will be understood. Further, if the integrated circuit unit has rows of strip-type terminals oriented in the usual way in such units, the pairs 26.2*a*, 26.2*b* of spring leaves are adapted to provide both edge and face engagement with such strip terminals.

Figure 5:
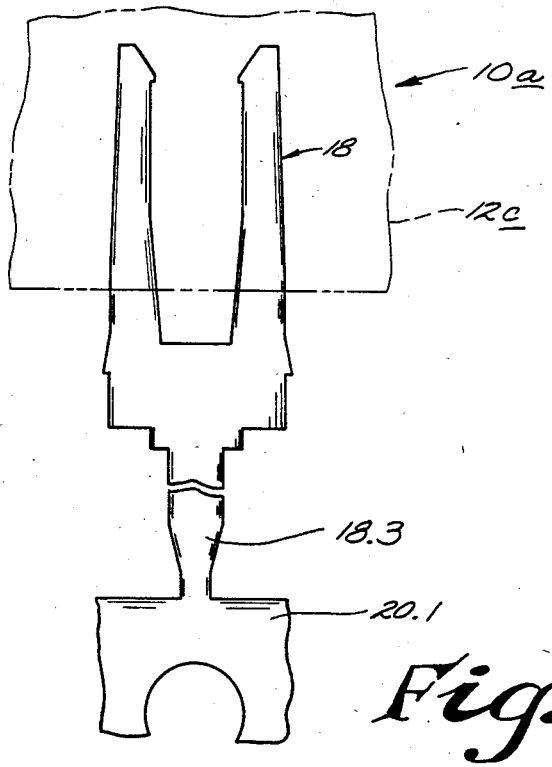
FIG. 5 is a section view similar to FIG. 2 illustrating an alternate embodiment of the connector of this invention.

Another alternate embodiment 10*a* of the connector is shown in FIG. 5 where in structural features corresponding to those illustrated in FIGS. 1–4 are identified with corresponding numerals. In the connector 10, the retainers 18*a* are temporarily connected to the support strip means 20.1*a* at the retainer post 18.3*a* and the connector body 12*c* is adapted to receive the retainers by bottom loading into the body openings.

Figure 6:
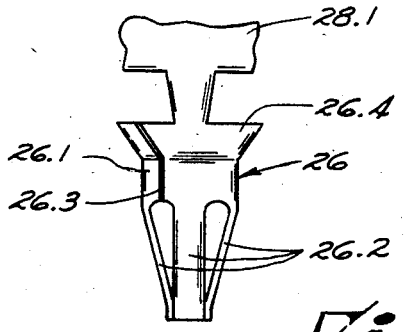
FIG. 6 is a side elevation view similar to FIG. 4 illustrating another alternate embodiment of this invention.

In another alternate embodiment, as illustrated in FIG. 6, the spring clips 26 have a conical portion 26.4 for facilitating reception of i.c. terminals within the clip.

Figure 7:
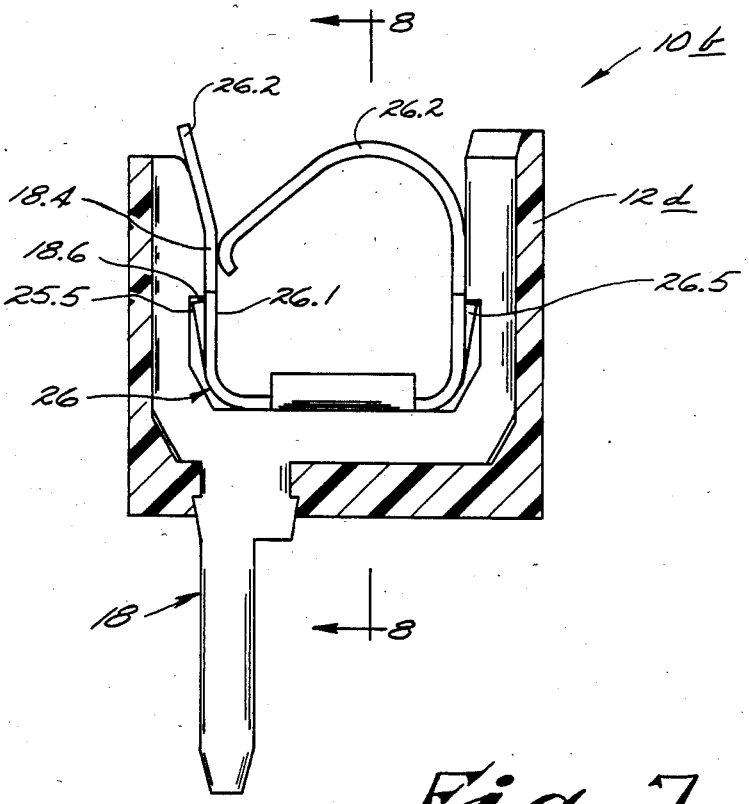
FIG. 7 is a section view similar to FIG. 2 illustrating another alternate embodiment of this invention.
Figure 8:
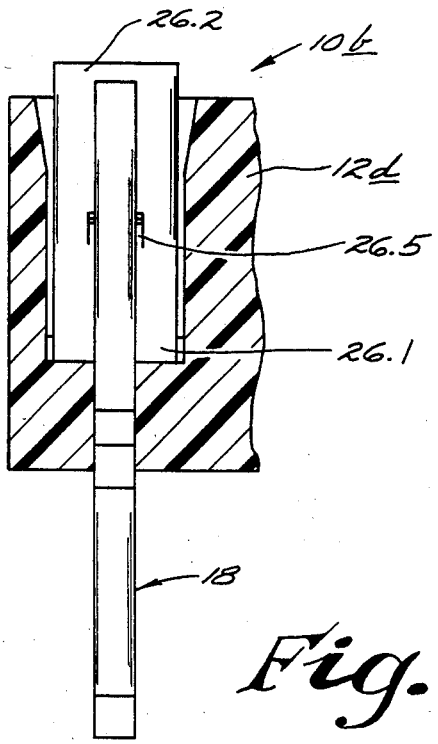
FIG. 8 is a section view along line 8—8 of FIG. 7.
Figure 9:
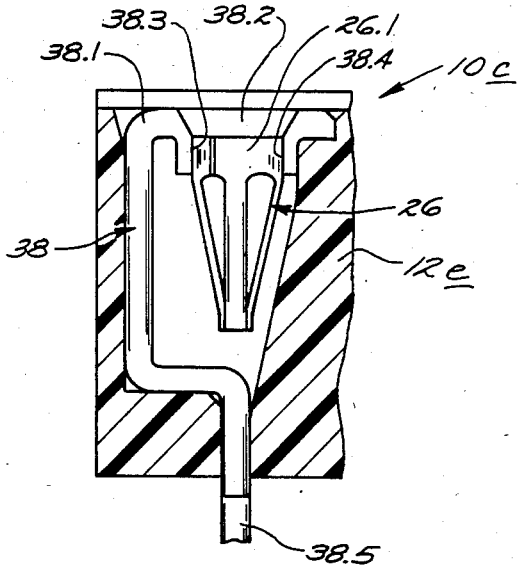
FIG. 9 is a section view similar to FIG. 2 illustrating another alternate embodiment of this invention.

In another alternate embodiment 10*b* of the connector as illustrated FIGS. 7 and 8, the spring clip loop 26.1 has tabs 26.5 struck out from the loop and engaged with detents 18.6. One spring leaf 26.2 preferably extends in a fairly straight direction a short way out of the body opening 14 to obliquely engage an i.c. terminal to be inserted into the opening and the juxtaposed spring leaf 26.2 preferably extends across the opening and curves back on itself to resiliently engage the straight leaf.

In another alternate embodiment of the connector 10*c*, alternate retainers 38 are used for receiving the spring clips 26. The alternate retainers preferably have a tab 38.1 at one end of the retainer provided with an opening 38.2 for providing selected tab surfaces 38.3, 38.4 which are juxtaposed in spaced, facing relation to each other. The retainers also have posts 38.5 extending from the body opening 14. In that arrangement, the spring clip loops 26.1 are received between tab surfaces 38.3, 38.4 and are biased into resilient electrical engagement with the retainer as previously described. When the clips are inserted into the body openings to be received within the tab openings from support strip means as previously described, the spring clips again have the desired uniform orientation in the connector body openings as in the connector 10.

It should be understood that although particular embodiments of the connector and methods of this invention have been described by way of illustrating invention, this invention includes all modifications and equivalents of the described embodiments falling within the scope of the appended claims.

We claim:

1. A connector comprising an insulating body having an opening extending through the body, an electrically conductive retainer formed of sheet metal having a pair of spaced wings lying in a common plane extending from the retainer in one direction so that surface portions on the respective sheet metal wings are disposed in spaced facing relation to each other and having a post unitary therewith extending from the retainer in an opposite direction, the retainer being attached to the body in the body opening with the retainer post extending from the opening at one side of the body to be connected in an electrical circuit and with the retainer wings disposed in fixed position in the opening adjacent an opposite side of the body with said plane of the retainer wings extending along a longitudinal axis of the opening, and a spring clip having an interrupted ring loop of resilient, electrically conductive sheet metal spring material disposed between said retainer surface portions having portions of the loop biased into resilient electrical engagement with the respective sapced facing surface portions of the retainer wings to position the interrupted ring loop to extend in a plane normal to the longitudinal axis of the opening and to said plane of the retainer wings, the spring clip having portions of the spring clip in juxtaposed relation to each other to make detachable, resilient electrical engagement to a terminal inserted within the interrupted ring loop to connect the terminal in said electrical circuit.

2. A high reliability low cost connector comprising an electrically insulating body having a opening, an electrically conductive retainer formed of sheet metal having a pair of wings lying in a common plane extending from the retainer in one direction with respective surfaces of the wings juxtaposed in spaced facing relation to each other and having a post unitary therewith extending from the retainer in an opposite direction, the retainer being attached to the body in the body opening with the post extending from the opening at one side of the body to be connected in an electrical circuit and with the retainer wings disposed in fixed position in the opening adjacent an opposite side of the body with said plane of the retainer wings extending along the longitudinal axis of the opening, and a spring clip having an interrupted ring loop of an electrically conductive sheet metal spring material disposed in the opening between the retainer wings with portions of the loop biased into resilient electrical engagement with the respective spaced facing surface of the retainer wings to position the interrupted ring to extend in a plane normal to the longitudinal axis of the opening and to said plane of the retainer wings, the spring clip having a plurality of integral spring leaves extending from the loop in juxtaposed relation to each other to make detachable, resilient electrical engagement to a terminal inserted between the spring leaves to electrically connect the terminal in said electrical circuit.

3. A high reliability low cost connector comprising an electrically insulating body having a plurality of openings extending between opposite sides of the body and spaced in a pair of rows which extend along a length of the body, a plurality of flat electrically conductive retainers formed of sheet metal each having a pair of wings disposed in spaced relation to each other lying in a common plane extending from the retainer in one direction with respective edge surfaces of the wings juxtaposed in spaced facing relation to each other and having a post unitary past extending in an opposite direction from the wings in said plane, the retainers being attached to the body in the respective body openings with the post thereof extending from the respective openings at one side of the body and with the retainer wing pairs received within the respective openings at the opposite side of the body extending along a longitudinal axis of the opening, and plurality of spring clips each having an interrupted wing loop of resilient, electrically conductive sheet metal spring material disposed within a respective body opening at said opposite sides of the body between the pair of retainer wings in the opening with portions of the clip loop biased into resilient electrical engagement with the respective spaced facing surfaces of the pair of retainer wings in the opening to position the interrupted ring loop to extend in a plane normal to the longitudinal axis of the opening and to the plane of the retainer wings in the opening, the spring clips each having a plurality of integral spring leaves extending from the loop thereof in juxtaposed relation to each other to make detachable, resilient electrical engagement to a terminal inserted into a body opening between the spring leaves of the clip to electrically connect the terminal in the electrical circuit.

4. A connector according to claim 3 wherein the retainers are disposed in the body opening with said pairs of the retainer wings extending in the direction of said length of the insulating body.

5. A connector according to claim 4 wherein notches are provided in the body openings at said opposite side of the body receiving edges of the retainer wings therein for orienting the retainers in the body openings.

6. A connector according to claim 4 having detent means on said surface portions of the retainers wings engaging the spring clips for detachably retaining the spring clips in selected position in the body openings in electrical engagement with the retainer wings.

7. A connector contact comprising an electrically conductive retainer of sheet metal having a pair of wings lying in a common plane extending from the retainer in one direction so that surface portions on the respective sheet metal wings are disposed in spaced facing relation to each other and having a post unitary therewith extending from the retainer in an opposite direction, and spring clip having an interrupted ring loop of electrically conductive sheet metal spring material disposed between said retainer wing surface portions having Portions of the loop biased into resilient electrical engagement with the respective spaced facing retainer wing surface portions to position the interrupted ring loop to extend in a plane normal to the plane of the retainer wings, the spring clip having a plurality of integral spring leaves extending from the loop in juxtaposed relation to each other to make detachable resilient electrical engagement to a terminal inserted between the spring leaves.

8. A high reliablilty low cost connector contact comprising a flat retainer of an electrically conductive sheet metal having a pair of wings disposed in spaced side-by-side relation to each other other in a common plane extending from the retainer in one direction with respective edge surfaces of the wings juxtaposed in spaced facing relation to each other and having a post unitary therewith extending in an opposite direction from the retainer wings in said plane, and a spring clip having an interrupted ring loop of electrically conductive sheet metal spring material disposed between the pair of retainer wings with a portion of the clip loop biased into resilient electrical engagement with the respective spaced facing surface of the pair of retainer wings to position the interrupted ring loop to extend in a plane normal to the plane of the retainer wings, the spring clip having a plurality of integral spring leaves extending from the loop in juxtaposed relation to each other to make detachable, resilient electrical engagement to a terminal inserted between the spring leaves of the clip.

9. A connector contact according to claim 8 having detent means on said spaced facing surfaces of the retainer wings engaging the spring clip for detachably retaining the spring clip in electrical engagement with the retainer wings.

* * * * *